US010411382B2

(12) United States Patent
Sichmann et al.

(10) Patent No.: US 10,411,382 B2
(45) Date of Patent: Sep. 10, 2019

(54) CONTACT ELEMENT AND MULTIPLE CONTACT ASSEMBLY

(71) Applicant: Weidmüller Interface GmbH & Co. KG, Detmold (DE)

(72) Inventors: Wolfgang Sichmann, Hüttenberg (DE); Stefan Aporius, Detmold (DE)

(73) Assignee: Weidmüller Interface GmbH & Co. KG (DE)

( * ) Notice: Subject to any disclaimer, the term of this patent is extended or adjusted under 35 U.S.C. 154(b) by 0 days.

(21) Appl. No.: 15/775,967

(22) PCT Filed: Nov. 8, 2016

(86) PCT No.: PCT/EP2016/076957
§ 371 (c)(1),
(2) Date: May 14, 2018

(87) PCT Pub. No.: WO2017/089117
PCT Pub. Date: Jun. 1, 2017

(65) Prior Publication Data

US 2018/0331448 A1 Nov. 15, 2018

(30) Foreign Application Priority Data

Nov. 27, 2015 (DE) ..... 20 2015 106 472 U

(51) Int. Cl.
*H01R 11/22* (2006.01)
*H01R 13/11* (2006.01)

(52) U.S. Cl.
CPC ..... *H01R 13/112* (2013.01); *H01R 13/113* (2013.01)

(58) Field of Classification Search
CPC ..... H01R 13/2442
USPC ..... 439/857, 947
See application file for complete search history.

(56) References Cited

U.S. PATENT DOCUMENTS 5,080,613 A * 1/1992 Orui ..... H01R 12/737 439/188
6,890,221 B2 * 5/2005 Wagner ..... H01R 12/7088 439/65
7,114,971 B1 10/2006 Johnson et al.
8,992,236 B2 3/2015 Wittig
(Continued)

FOREIGN PATENT DOCUMENTS

DE 102005047603 A1 4/2007
DE 102011002073 A1 9/2012
DE 202011110604 U1 2/2015
(Continued)

*Primary Examiner* — Phuong K Dinh
(74) *Attorney, Agent, or Firm* — Laubscher & Laubscher, P.C.

(57) ABSTRACT

A contact element for electrically connecting an electrical conductor with an electrical assembly includes two contact rails extending in a longitudinal direction. The rails are arranged one above the other and are at a distance from one another in a contact direction and are also connected to each other via a connection piece. The connection piece is arranged at a first side of the contact rails and extends in the longitudinal direction and in the contact direction so that the contact element is formed in an approximately U-shaped manner in a cross section transversely to the longitudinal direction which runs through the connection piece.

6 Claims, 5 Drawing Sheets

(56) References Cited

U.S. PATENT DOCUMENTS

| | | | |
|---|---|---|---|
| 2004/0147177 | A1 | 7/2004 | Wagner |
| 2013/0244504 | A1 | 9/2013 | Ogura |

FOREIGN PATENT DOCUMENTS

| | | | |
|---|---|---|---|
| EP | 0726615 | A2 | 8/1996 |
| GB | 2279823 | A | 1/1995 |

* cited by examiner

CONTACT ELEMENT AND MULTIPLE CONTACT ASSEMBLY

This application is a § 371 of PCT/EP2016/076957 filed Nov. 8, 2016. PCT/EP2016/076957 claims priority of DE 20 2015 106 472.1 filed Sep. 27, 2015. The entire contents of these applications are incorporated herein by reference.

BACKGROUND OF THE DISCLOSURE

The present disclosure relates to a contact element and a multiple contact socket or assembly for connecting an electrical conductor with an electrical assembly.

For connecting electrical conductors with electrical assemblies, it is known to use contact elements having several bearing surfaces against the conductor. In this way, the current transmitted from the conductor to the electrical assembly is distributed over the several bearing surfaces and accordingly diminished at each individual bearing surface.

BRIEF DESCRIPTION OF THE PRIOR ART

German patent No. DE 20 2011 110 604 U1 discloses a spring pressure element with two end regions, each of which is formed as a contact region. The contact regions are designed to bear against a bus bar. The spring pressure element is made from a rail extending in a longitudinal direction, curved into a loop, so that an acute angle is formed between the first end region and a middle piece joining the end regions, and an obtuse angle exists between the middle piece and the second end region. The end regions are therefore arranged at the open ends of the spring pressure element. In one embodiment, two such spring pressure elements are joined together by a contact element to form a four-contact spring pressure element. For this, the contact element is arranged at the middle piece of both spring pressure elements and extends transversely to them. Via the contact element, the bus bar can be connected to an electrical assembly.

The drawback to this spring pressure element and four-contact spring pressure element is that the current path from the end regions to the contact rail is long. Furthermore, the contact force by which the end regions are each pressed against the bus bar is strongly influenced by the respective other end region of the same spring pressure element, so that the contact force at the contact regions of the same spring pressure element is different and dependent on the angles between the end regions and the middle piece.

The problem by the present disclosure is to create a contact element in which the current path is small, and the contact pressure of the bearing surfaces against an electrical conductor component is negligibly affected each time by the other bearing surface of the same contact element, and in particular is roughly the same. In addition, the contact element can be manufactured inexpensively.

SUMMARY OF THE DISCLOSURE

For this purpose, a contact element is created for connecting an electrical conductor with an electrical assembly. The contact element includes two contact rails extending in a longitudinal direction, which are arranged one above the other and are at a distance from one another in a contact direction. The contact rails are connected to each other via a connection element.

The connection element is arranged at a first side of the contact rails, and extends in the longitudinal direction and in the contact direction, so that the contact element is formed in an approximately U-shaped manner in cross section transversely to the longitudinal direction which extends through the connection piece.

The contact rails are therefore not joined together along the longitudinal direction, but instead they each have two open ends. The current path therefore does not flow through a loop-shaped middle element, but instead is led at the side into the connection element. Owing to the lateral arrangement of the connection element the current path is shortened. Therefore, the heat caused by the current can be dissipated more quickly.

Since the contact rails are not connected to each other along the longitudinal direction, their angles do not directly influence each other. The contact force by which one of the two contact rails lies against the conductor component is therefore barely or not at all influenced by the other contact rail. The contact force of the contact rails is therefore largely adjustable independently of each other. Preferably, the contact rails are so dimensioned, especially their length, their shape, and/or the material of which they are made, that the contact force of the contact rails of the contact element is roughly the same.

An electrical conductor component according to the disclosure is both an at least partly flat configured electrical conductor, such as a bus bar, or an electrically conducting contact surface, such as on a printed circuit hoard.

Preferably, the front contact rail in the contact direction extends in the longitudinal direction beyond the rear contact rail in the contact direction. In this way, the contact rails can be arranged one above the other, without mutually touching. The contact rail extending in the longitudinal direction beyond the other contact rail shall be referred to as the first contact rail, and the other contact rail shall be referred to as the second contact rail.

The contact rails preferably each have a first open end and a second open end situated opposite the first open end. At their first open end or near the first open end, a bearing surface is provided for bearing against the conductor. The contact rails preferably lie with a broad side flush against the conductor component. The broad side preferably extends in the longitudinal direction and in a transverse direction, which runs transversely to the longitudinal direction and transversely to the contact direction. At the side, the contact rails preferably have two narrow sides, arranged opposite each other and adjacent to the broad side. The narrow sides preferably extend in the longitudinal direction and in the contact direction.

It is preferred that the connection element is arranged at narrow sides of the contact rails arranged aligned one above the other. The connection element is preferably formed as a single element with them, preferably as a stamped and bended part from a flat strip material which extends flat in the longitudinal direction and the contact direction.

Accordingly, the contact rails are preferably arranged parallel to each other in a connection region in which the connection element is arranged on the contact rails. A connection angle between the contact rails and the connection element is preferably 90°.

In order to increase the number of bearing surfaces, it is furthermore preferred that the contact rails each have at least two or more contact tongues or prongs, which are arranged alongside each other in a transverse direction. Preferably, each of the contact prongs has a bearing surface. The contact prongs preferably extend from the connection region to the first open end.

In order to ensure that the contact prongs lie by the bearing surfaces against the conductor component, it is furthermore preferred that the contact prongs are bent or kinked in the contact direction, preferably at an obtuse angle.

Furthermore, it is preferable for the contact prongs to be arch-shaped at the bearing surface, so that they do not have any sharp edges, and the conductor component is not damaged by the contact prongs. Thus, the contact prongs preferably have an obtuse-angled arch.

The problem is furthermore solved by a multiple contact assembly with at least two such contact elements. The multiple contact assembly is designed to bear against opposite sides of the conductor. For this purpose, the contact elements are preferably symmetrically arranged relative to a center plane. Preferably they are arranged one above the other in the contact direction. In this way, the conductor is clamped between the contact rails.

The first contact rails, extending beyond the second contact rails in the longitudinal direction, are therefore preferably arranged at the outside, and the second contact rails at the inside of the multiple contact assembly.

In order to secure the contact elements in mirror symmetry to the center plane, it is preferable for them to be joined together by a connection element. The connection element is preferably arranged in the connection region of the contact elements.

Furthermore, it is preferred that adjacent connection elements of the multiple contact assembly are each arranged at opposite narrow sides of the same contact rail. This makes easy sliding of the conductor possible between the contact elements. The conductor can then be inserted in between the contact elements and into the multiple contact assembly as far as the connection region.

The multiple contact assembly is preferably formed in an approximately W-shaped manner in a cross section transversely to the longitudinal direction and running through the connection element. This configuration enables a single-element manufacture of the multiple contact assembly, especially as a stamped and bended element from flat strip material. The connection elements are each arranged parallel to one another in the connection region. Likewise, it is preferred that the contact rails are each arranged parallel to one another in the connection region.

The problem is furthermore solved by a multiple contact assembly, especially by a multiple contact assembly having four contact rails. The contact rails extend in a longitudinal direction. They are arranged one above another and at a distance from one another in a contact direction transversely to the longitudinal direction. The adjacent contact rails are each joined together by a connection element. Preferably, the multiple contact assembly is formed in an approximately W-shaped manner in a cross section transversely to the longitudinal direction.

Adjacent connection elements of the multiple contact assembly are therefore each arranged at opposite narrow sides of the same contact rail. This embodiment of the multiple contact assembly has the advantage that the conductor can be centrally inserted into the multiple contact assembly into the connection region.

Each time, two contact rails lie against opposite sides of the conductor. Preferably, they are arranged in mirror symmetry to each other. The contact force is then distributed symmetrically relative to the center plane on both sides. In this way, the conductor is securely clamped between the contact rails, especially between the contact prongs.

The multiple contact assembly has a plurality of bearing surfaces, by which it lies against the conductor. The bearing surfaces, especially those of the same contact rail and/or oppositely arranged contact rails, lie with roughly the same contact force against the conductor. In this way, for example, an accidentally bent contact prong during the installation process has little or no influence on the other contact prongs and the contact force by which they lie against the conductor owing to the lateral arrangement of the connection elements.

On the whole, the current path which the electric current takes from the electrical assembly to the conductor or vice versa is short, due to the laterally situated connection elements, and therefore electric power or heat can be quickly dissipated via the multiple contact assembly.

The multiple contact assembly can be manufactured as a single element, especially from a flat strip material, as a stamped and bended part. It can therefore be manufactured inexpensively.

BRIEF DESCRIPTION OF THE FIGURES

Other objects and advantages of the disclosure will become apparent from a study of the following specification when viewed in the light of the accompanying drawing, in which.

DETAILED DESCRIPTION

Figure 1A:
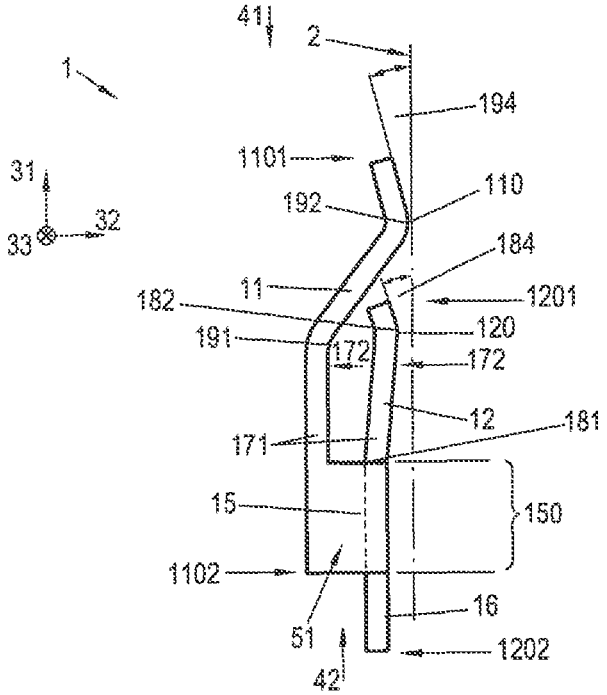
FIG. 1*a* is a side view of a contact element with two contact rails.

FIG. 1*a* shows a first side 51 of an electrical contact element 1. The contact element 1 has two contact rails 11, 12, which extend in a longitudinal direction 31. The contact rails 11, 12 are arranged one above the other in a contact direction 32. They are at a distance from one another in the contact direction 32.

In order to join the contact rails 11, 12 together, a connection element 15 is provided. The connection element 15 is arranged at the first side 51 of the contact rails 11, 12 such that the contact element 1 is formed approximately in a U-shape in a cross section transversely to the longitudinal direction 31, extending through the connection element 15 as shown in FIG. 1*d*. The contact rails 11, 12 form the parallel legs of the U-shape and the connection element 15 forms the junction of the legs extending transversely thereto.

In a connection region 150 in which the contact rails 11, 12 are joined together by the connection element 15, the rails extend substantially parallel to each other.

In order to arrange the contact rails 11, 12 one above the other without touching each other, the front or first contact rail 11 in the longitudinal direction 31 extends beyond the rear or second contact rail 12 in the contact direction 32.

The contact rails 11, 12 are designed to bear against a conductor 2 and thus include a kink or bend 181, 191. In the kink 181, 191, the contact rails 11, 12 are bent at an obtuse angle 180, 190 in the contact direction 32 as shown in FIG. 1*c*. The kinks 181, 191 of the contact rails 11, 12 are offset from each other in the longitudinal direction 31. The kink 181 of the second contact rail 12 is situated in the longitudinal direction 31 in front of the kink 191 of the first contact rail 11. It is provided directly at the connection region 150, while the kink 191 of the first contact rail 11 is at a distance from the kink 181 in the longitudinal direction 31.

The contact rails 11, 12 have a rear or first open end 1101, 1201 in the longitudinal direction 31 and a front or second open end 1102, 1202 in the longitudinal direction 31. In the longitudinal direction 31, in front of the first open end 1101, 1201, there is provided a bearing surface 110, 120, which is designed to bear against the conductor component 2.

To prevent damage to the conductor 2 by the bearing surface 110, 120, the contact rails 11, 12 have an arch shape at the bearing surface 110, 120. The arches 182, 192 each have an obtuse angle 183, 193 as shown in FIG. 1*c*. In this way, no sharp edges are present in the bearing surfaces 110, 120.

The contact rails 11,12 each have two opposite narrow sides 171, 171' and two opposite broad sides 172, 172'. FIG. 1*a* shows one of the two narrow sides 171. The bearing surface 110, 120 of the contact rails 11, 12 is provided on one of the broad sides 172 of the contact rails 11, 12.

In order to manufacture the contact element 1 inexpensively, it is formed as a single element from a flat strip material. The connection element 15 is arranged at one of the narrow sides 171, 171' of the contact rails 11, 12, in the present case at the narrow side 171 of the first side 51. The flat strip material is bent around a connection angle 195 shown in FIG. 1*d*. The connection angle 195 between the contact rails 11, 12 and the connection element 15 is around 90°. The connection element 15 therefore extends substantially in the longitudinal direction 31 and the contact direction 32.

Figure 1B:
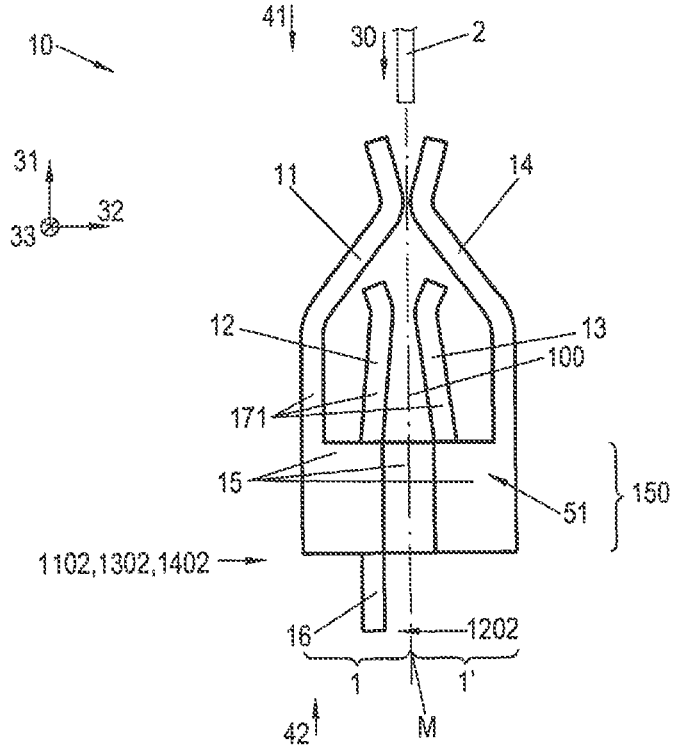
FIG. 1*b* is a side view of a multiple contact assembly with two contact elements.
Figure 1C:
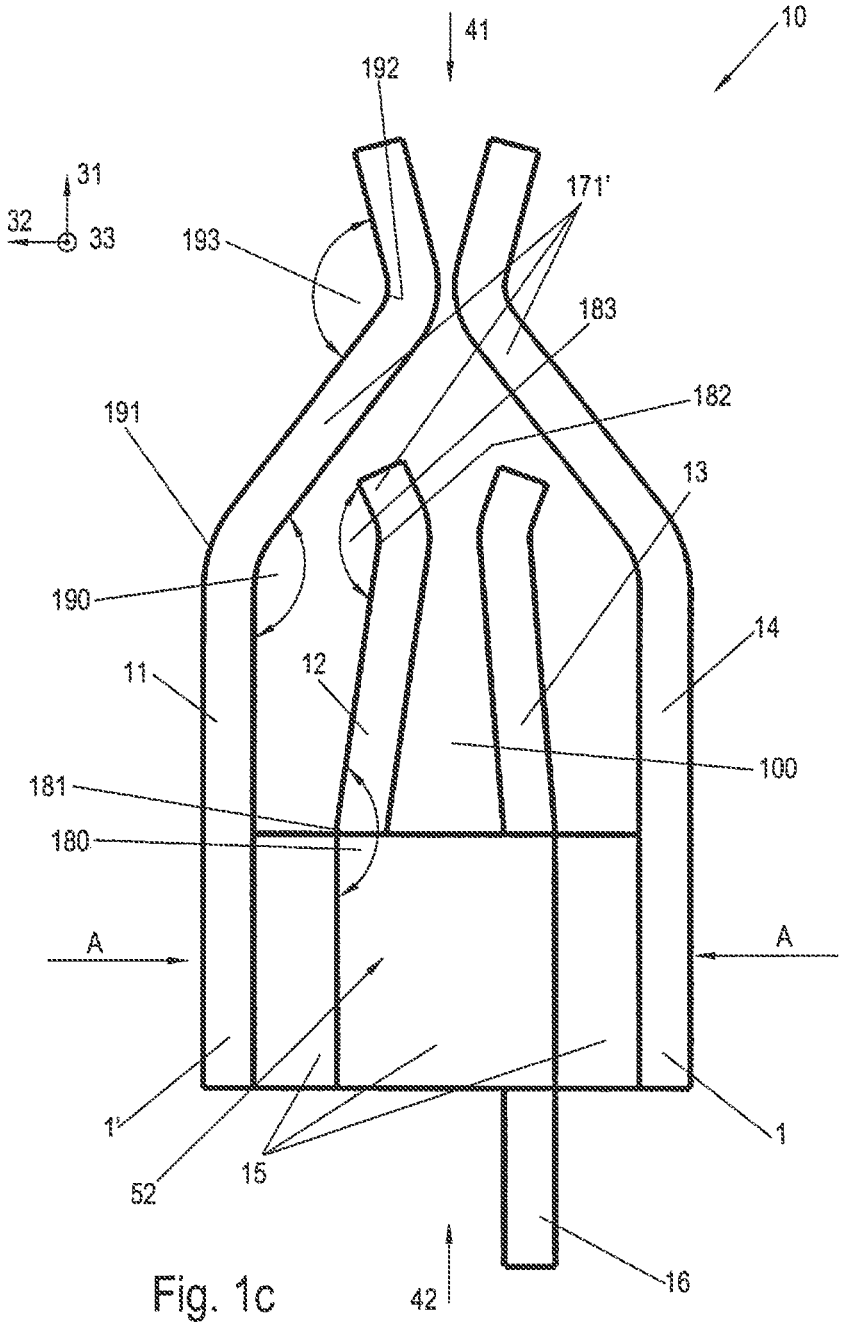
FIG. 1*c* is a side view of the multiple contact assembly shown in FIG. 1*b* from the opposite side.
Figure 1D:
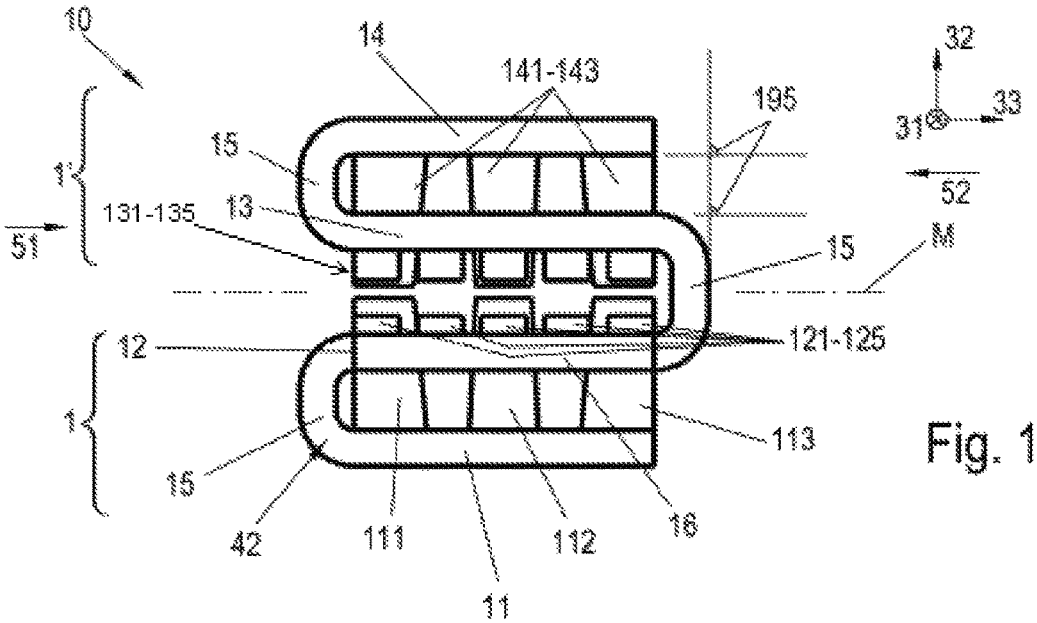
FIG. 1*d* is a rear view of the multiple contact assembly of FIGS. 1*b* and 1*c;*
Figure 1E:
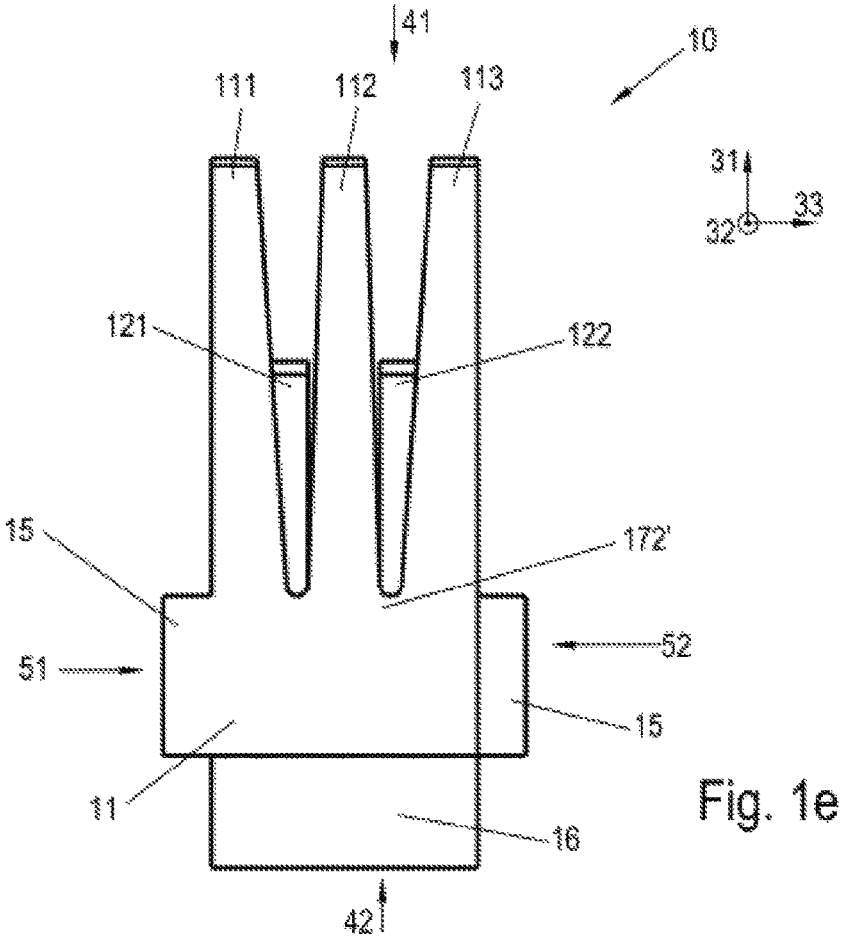
FIG. 1*e* is a side view of another embodiment of a multiple contact assembly with two contact elements.
Figure 1F:
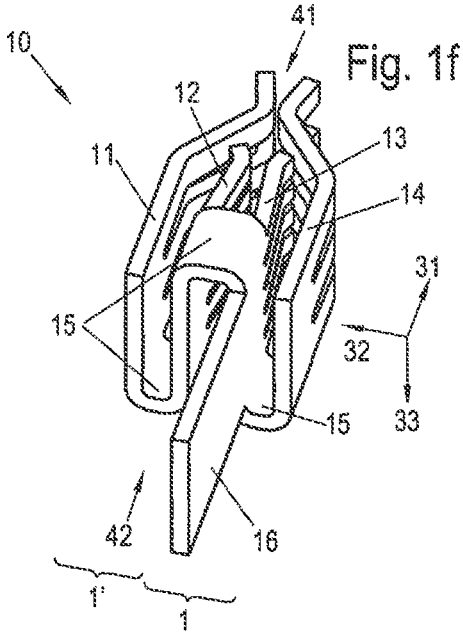
FIGS. 1*f* and 1*g* are front and rear perspective views of the multiple contact assembly shown in FIGS. 1*b* and 1*c*, respectively.
Figure 1G:
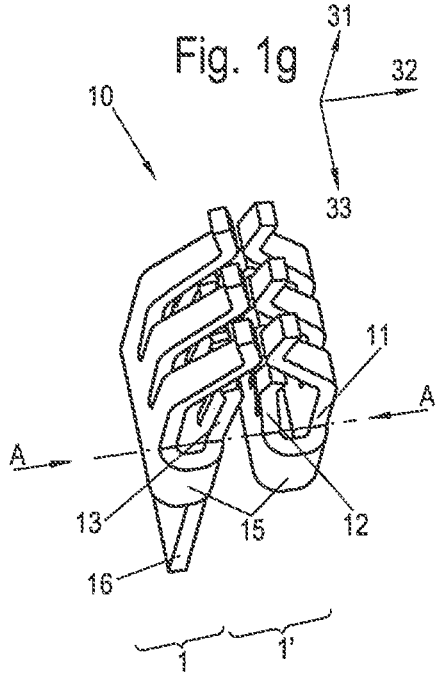
Figure 1H:
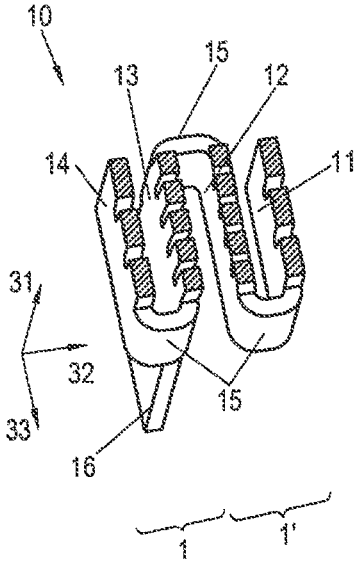
FIG. 1*h* is a sectional view of the multiple contact assembly shown in FIG. 1*g* taken along line A-A.
Figure 1I:
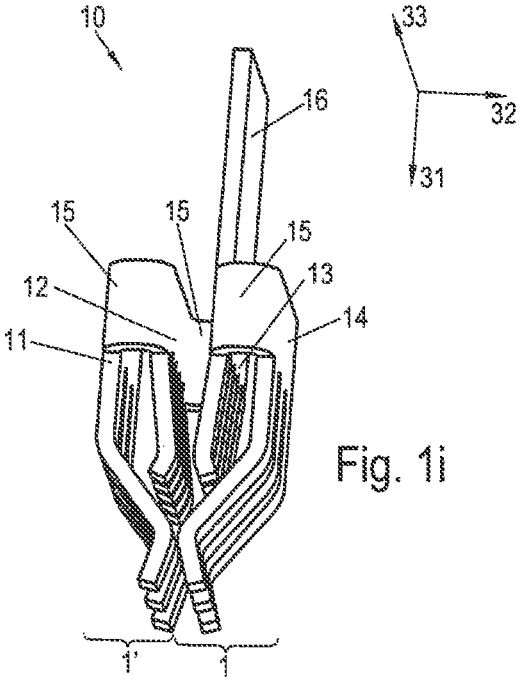
FIG. 1*i* is a bottom perspective view of the multiple contact assembly shown in FIG. 1*b*.

In order to increase the number of bearing surfaces 110, 120, the contact rails 11, 12 each have at least two contact prongs 111-113, 121-125 as shown in FIGS. 1*d* and 1*e*. The contact prongs 111-113, 121-125 are arranged alongside each other in a transverse direction 33, which extends transversely to the longitudinal direction 31 and transversely to the contact direction 32. The prongs are formed by groove-like incisions (not shown) in the contact rails 11, 12.

In order to connect the contact element 1 to an electrical assembly, a terminal 16 is arranged on the second contact rail 12. The second contact rail 12 therefore extends beyond the connection element 15 by the terminal 16 against the longitudinal direction. On the contrary, the second open end 1102 of the first contact rail 11 is provided flush with the connection element 15 in the longitudinal direction 31.

The terminal 16 is formed as a single element with the second contact rail 12. In this way, the second open end 1202 of the second contact rail 12 is arranged before the second open end 1102 of the first contact rail 11 in the longitudinal direction 31.

FIGS. 1*b*-1*d* show a multiple contact socket or assembly 10 formed from two such contact elements 1, 1'. The two contact elements 1, 1' of the multiple contact assembly 10 are symmetrically arranged relative to a center plane M. FIG. 1*b* shows the first side 51 of the multiple contact assembly 10 where a first of the two narrow sides 171 of the contact rails 11, 12, 13, 14 of the contact elements 1, 1' can be seen. FIG. 1*c* shows the second side 52 of the multiple contact assembly 10, situated opposite the first side 51, so that the second narrow side 171 the contact rails 11, 12, 13, 14 of the contact elements 1,1' situated opposite the first narrow side 171 can be seen. FIG. 1*d* shows a rear end face 42 of the multiple contact assembly 10. A front end face 41 of the multiple contact assembly 10 is shown in The multiple contact assembly 10 has two contact rails for each contact element 1, 1' for a total of four rails 11-14. The contact rails 11-14 each extend in the longitudinal direction 31. They are arranged one above another in the contact direction 32, and at a distance from one another. The first contact rails 11, 14 of the two contact elements 1,1', extending in the longitudinal direction 31 beyond the other second contact rails 12, 13, are arranged on the outside of the multiple contact assembly 10. The second contact rails 12, 13 are accordingly arranged on the inside.

The bearing surfaces 110, 120 are arranged opposite each other. The conductor 2 can therefore be moved in a sliding direction, which extends against the longitudinal direction 31, from the front end face 41 into the multiple contact assembly 10. It is clamped between the contact rails 11-14 by the contact force of the rails. A contact space 100 to receive the conductor 2 is centrally arranged within the multiple contact assembly 10 between the contact elements 1, 1'.

The adjacent contact rails 11-14 are joined together by a connection element 15. The connection elements 15 are arranged at mutually opposite narrow sides 171, 171' of the same contact rail 11-14. In this way, the multiple contact assembly 10 has an approximately W shape in a cross section running transversely to the longitudinal direction 31 and in the connection region 150 as shown in FIG. 1*d*. In this way, the conductor 2 can be inserted as far as the connection region 150 into the multiple contact assembly 10.

For connection of the multiple contact assembly 10 to an electrical assembly, one of the two contact elements 1 has a second contact rail 12 with a terminal 16. No additional terminal 16 is provided on the other contact element 1'. In the contact element 1' with no terminal 16, the second open ends 1302, 1402 of the contact rails 13, 14 are therefore arranged flush with each other and with the connection element 15.

In FIG. 1*d* the contact prongs 111-113, 121-125, 131-135, 141-143 of the contact rails 11-14 are shown. In this sample embodiment, the first contact rails 11, 14 each have three contact prongs 111-113, 141-143. The second contact rails 12, 13 on the other hand each have five contact prongs 121-125, 131-135. This is also shown in the perspective views of FIGS. 1*f* to 1*i*.

Furthermore, the roughly W-shaped arrangement of the contact rails 11-14 and the connection elements 15 to each other is shown in FIGS. 1*f* to 1*i*.

FIG. 1*e* shows another side view of another embodiment of a multiple contact assembly 10. The multiple contact assembly 10 differs from the multiple contact assembly 10 of FIGS. 1*b*, 1*c*, 1*d*, 1*f*, 1*g*, 1*h* and 1*i* by the number of contact prongs 121-122, 131-132 provided at the second contact rails 12, 13. Here, the second contact rails 12, 13 each only have two contact prongs 121,122, 131, 132.

Figure 2:
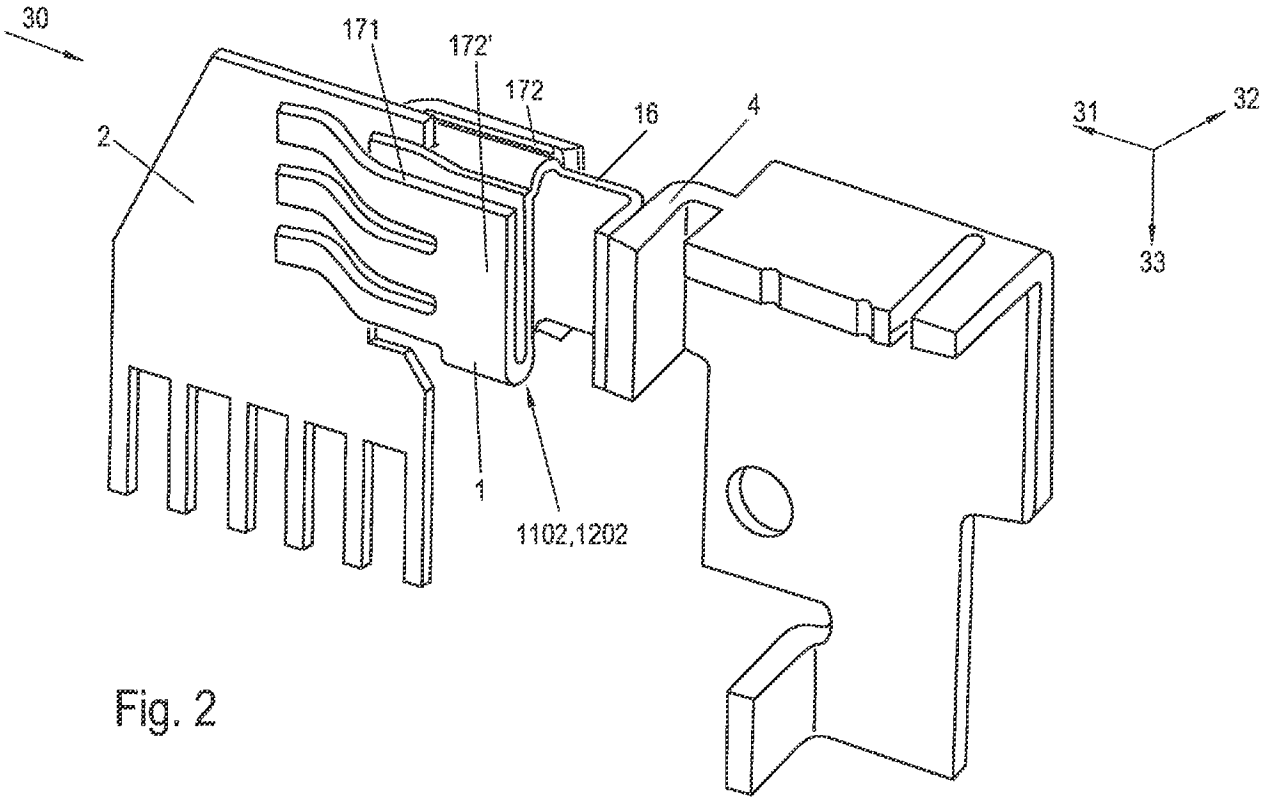
FIG. 2 is a perspective view of a multiple contact assembly connected with an electrical assembly.

FIG. 2 shows an exemplary arrangement with the multiple contact assembly 10 of FIGS. 1*b*, 1*c* and 1*d*, a contact part 4 of an electrical assembly not otherwise shown, and a conductor 2. The conductor 2 is a printed circuit board, which is moved in the sliding direction 30 into the contact space 100 between the two contact elements 1, 1' of the multiple contact assembly 10 and clamped therein. The contact part 4 of the electrical assembly lies against or is connected with the terminal 16 in electrical contact.

While the preferred forms and embodiments of contact element and multiple contact assembly have been illustrated and described, it will be apparent to those of ordinary skill in the art that various changes may be made.

The invention claimed is:

1. A multiple contact assembly for connecting an electrical conductor with an electrical assembly, comprising (a) first, second, third and fourth contact rails extending in a longitudinal direction and spaced from one another in a contact direction; and (b) first, second and third connection elements extending in the contact direction, said first connection element connecting first ends of said first and second contact rails, said second connection element connecting second ends of said second and third contact rails, and said third connection element connecting first ends of said third and fourth contact rails, said contact rails and connection elements having a serpentine configuration to define a pair of adjacent symmetrically arranged contact elements each having a U-shape in cross-section; and (c) a plurality of spaced contact prongs extending from said first, second, third and fourth contact rails, respectively, said contact prongs of said second and third rails extending a first distance from said second and third rails and said contact prongs of said first and fourth rails extending a second distance greater than said first distance from said first and fourth contact rails, said contact prongs of said first and second contact rails defining a first contact space which receives and retains a first conductor and said contact prongs of said third and fourth contact rails defining a second contact space which receives and retains a second conductor.

2. A multiple contact assembly as defined in claim 1, wherein free ends of said contact prongs of said first and fourth contact rails extend over and above free ends of said contact prongs of said second and third contact rails, respectively.

3. A multiple contact assembly as defined in claim 2, wherein said contact prongs include bearing surfaces adjacent said free ends thereof for abutment against a conductor.

4. A multiple contact assembly as defined in claim 3, wherein said contact prongs are bent in the contact direction.

5. A multiple contact assembly as defined in claim 4, wherein said contact prongs of said first and fourth contact rails are wider than said contact prongs of said second and third contact rails.

6. A multiple contact assembly as defined in claim 5, wherein at least one of said contact prongs of said second and third contact rails are arranged opposite spaces between said contact prongs of said first and fourth contact rails, respectively.

* * * * *